US011605909B2

(12) United States Patent
Wu

(10) Patent No.: US 11,605,909 B2
(45) **Date of Patent: *Mar. 14, 2023**

(54) TERMINAL BLOCK WITH HANDLE

(71) Applicants: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,585

(22) Filed: Nov. 11, 2021

(65) Prior Publication Data

US 2022/0069487 A1 Mar. 3, 2022

Related U.S. Application Data

(63) Continuation of application No. 16/995,885, filed on Aug. 18, 2020, now Pat. No. 11,217,913.

(51) Int. Cl.
*H01R 9/24* (2006.01)

(52) U.S. Cl.
CPC ..... *H01R 9/2416* (2013.01)

(58) Field of Classification Search
CPC ..... H01R 9/2416; H01R 13/6271; H01R 13/6277; H01R 4/4836; H01R 4/4845
See application file for complete search history.

(56) References Cited

U.S. PATENT DOCUMENTS 9,525,216 B2 * 12/2016 Wu ..... H01R 13/62955

* cited by examiner

*Primary Examiner* — Vanessa Girardi
(74) *Attorney, Agent, or Firm* — Chun-Ming Shih; HDLS IPR Services

(57) ABSTRACT

The invention relates to a terminal block with a handle. The terminal block includes an insulative base, a conductive terminal, a flexible clamp and a toggle member. The insulative base has a chamber and an insertion hole communicating with the chamber. The conductive terminal is fixed at a bottom of the insertion hole. The flexible clamp is received in the chamber and extended with a movable elastic arm abutting against the conductive terminal and closing the inserting hole. The toggle member has a pivot rotatably connected in the chamber. The pivot is extended with a pusher abutting against the movable elastic arm. When the toggle member is rotated to a release position, the pusher is rotated about the pivot to press the movable elastic arm so the movable elastic arm deviates from the conductive terminal and the insertion hole is opened.

7 Claims, 7 Drawing Sheets

TERMINAL BLOCK WITH HANDLE

CROSS-REFERENCE TO RELATED APPLICATION

This application is a continuing application of U.S. patent application Ser. No. 16/995,885, filed on Aug. 18, 2020, and entitled "TERMINAL BLOCK WITH HANDLE." The entire disclosures of the above application are all incorporated herein by reference.

BACKGROUND OF THE INVENTION

Technical Field

The invention relates to terminal blocks, particularly to a terminal block with a handle.

Related Art

Terminal blocks are widely used in machine equipment (such as industrial computers, uninterrupted power systems, power supplies, etc.), industrial control equipment (such as electromechanical systems, refrigeration and air conditioning, programmable controllers, etc.) or household appliances (such as air conditioners, refrigerators, washing machines, ovens, etc.) as an electric connection device for multiple wires.

A conventional terminal block is composed of an insulative base and a conductive terminal. The insulative base is provided with an elastic sheet for fixing a wire. When the elastic sheet is pressed by a screwdriver or another similar tool, a wire can be inserted into the insulative base to form an electric connection with the conductive terminal. Finally, when the screwdriver or the other similar tool is removed, the wire is clasped by the elastic sheet and positioned in the insulative base.

However, when a conventional terminal block is implemented in wiring work, a screwdriver or another similar tool is not exclusively designed for wiring. So, requiring a screwdriver or another similar tool to implement a terminal block is inconvenient. Also, a screwdriver or another similar tool can easily damage the terminal block. Thus, improving the tool used in the wiring work of a terminal block is an important issue for the industry.

In view of this, the inventors have devoted themselves to the above-mentioned prior art, researched intensively, and cooperated with the application of science to try to solve the above-mentioned problems. Finally, an invention which is reasonable and effective in overcoming the above drawbacks is provided.

SUMMARY OF THE INVENTION

The invention provides a terminal block with a handle, which utilizes a toggle member to move a movable elastic arm away from a conductive terminal to avoid using a screwdriver or another similar tool. This improves the convenience of the terminal block.

In the embodiment, the invention provides a terminal block with a handle. The terminal block includes an insulative base, a conductive terminal, a flexible clamp and a toggle member. The insulative base has a chamber and an insertion hole communicating with the chamber. The conductive terminal is fixed at a bottom of the insertion hole. The flexible clamp is received in the chamber and extended with a movable elastic arm abutting against the conductive terminal and closing the inserting hole. The toggle member has a pivot rotatably connected in the chamber. The pivot is extended with a pusher abutting against the movable elastic arm. When the toggle member is rotated to a release position, the pusher is rotated about the pivot to press the movable elastic arm so as to make the movable elastic arm deviate from the conductive terminal and open the insertion hole.

In comparison with the conventional terminal block which requires a screwdriver or another similar tool, the invention rotates the toggle member to move the movable elastic arm to open or close the insertion hole or to clasp a core of the wire to make electric connection with the conductive terminal. This avoids requiring a screwdriver or another similar tool, improving the convenience of terminal blocks.

DETAILED DESCRIPTION OF THE INVENTION

Figure 1:
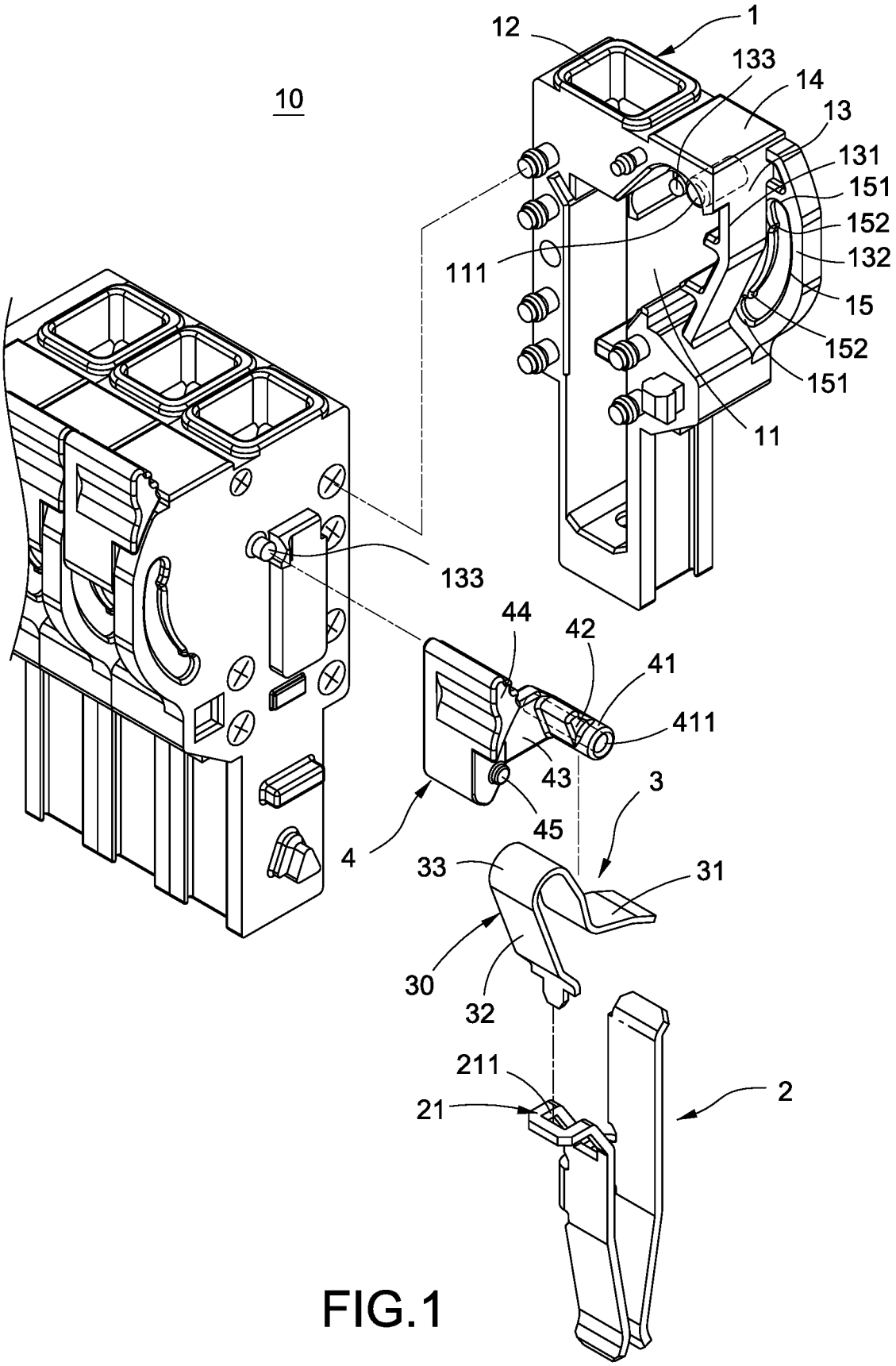
FIG. 1 is an exploded view of the terminal block of the invention.
Figure 2:
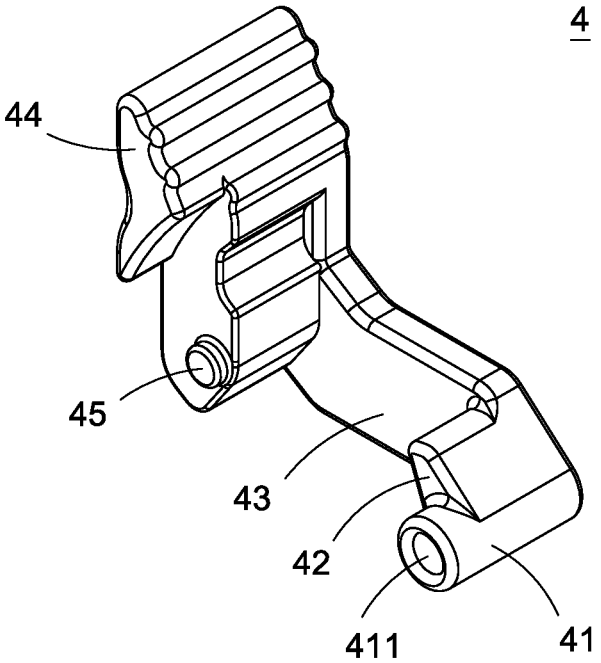
FIG. 2 is a perspective view of the toggle member of the invention.
Figure 3:
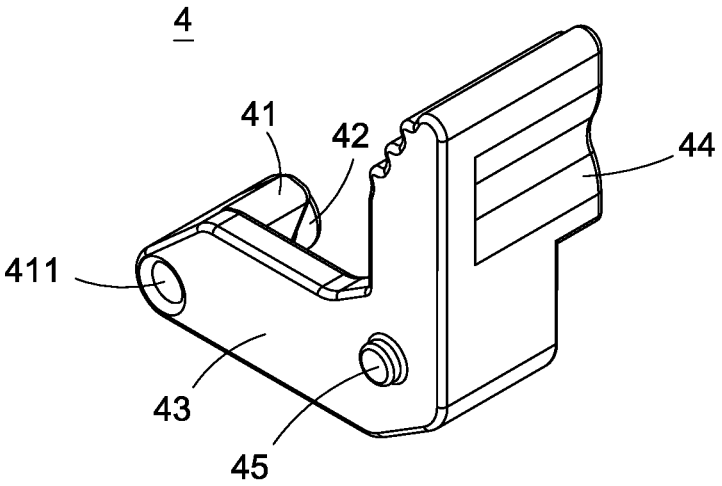
FIG. 3 is another perspective view of the toggle member of the invention.

To further disclose the features and technical contents of the invention, please refer to the following description and drawings. However, the drawings are used for reference and description only, not for the limitation of the invention.

Please refer to FIGS. 1-6. The invention provides a terminal block with a handle. The terminal block 10 includes an insulative base 1, a conductive terminal 2, a flexible clamp 3, and a toggle member 4.

As shown in FIGS. 1 and 4-6, the inside of the insulative base 1 has a chamber 11 and the outside thereof has an insertion hole 12. An inner wall of the chamber 11 is extended with a limiting rod 111.

In detail, the outside of the insulative base 1 has a front wall 13 and a top wall 14. The front wall 13 is formed with a through trough 131 communicating with the chamber 11. An inner wall of the through trough 131 is extended with two shafts 133. In this embodiment, the insertion hole 12 is formed in the top wall 14, but is not limited to this.

Additionally, the front wall 13 is outwardly extended with a projecting sheet 132. The projecting sheet 132 is formed with an arcuate guiding channel 15. The arcuate guiding channel 15 has two ends 151 and a protrusion 152 is formed at a side of each of the ends 151.

As shown in FIGS. 1 and 4-6, the conductive terminal 2 is fixed at the bottom of the insertion hole 12. The conductive terminal 2 has an engaging portion 21. In this embodiment, the engaging portion 21 is an engaging groove 211, but is not limited to this.

As shown in FIGS. 1 and 4-6, the flexible clamp 3 is received in the chamber 11 and atop the conductive terminal 2. The flexible clamp 3 is extended with a movable elastic arm 31 abutting against the conductive terminal 2 and closing the inserting hole 12.

In detail, the flexible clamp 3 is a U-shaped elastic sheet 30. Two ends of the U-shaped elastic sheet 30 are separately formed with a movable elastic arm 31 and a positioning elastic arm 32. A bending section 33 is formed between the two arms 31, 32. A distal end of the positioning elastic arm 32 passes through and engages with the engaging groove 211 to engage the distal end of the positioning elastic arm 32 with the engaging portion 21. The bending section 33 is put around the limiting rod 111.

As shown in FIGS. 1-6, the toggle member 4 is installed in the insulative base 1. The toggle member 4 has a pivot 41 rotatably connected in the chamber 11. The pivot 41 is extended with a pusher 42 abutting against the movable elastic arm 31. The pusher 42 is disposed above the movable elastic arm 31. The pivot 41 is provided with two pivoting holes 411 which are rotatably inserted by the two shafts 133 to make the pivot 41 rotatable about the two pivoting holes 411.

In detail, the toggle member 4 is received in the through trough 131. The toggle member 4 is extended with a handle 44 exposed from the front wall 13. The toggle member 4 is extended with a projecting rod 45 passing through and which is slidable in the arcuate guiding channel 15. The projecting rod 45 can be stopped by one of the protrusions 152

The toggle member 4 can be swayed between a locking position and a release position. When the handle 44 of the toggle member 4 is rotated to the release position, the pusher 42 is rotated about the pivot 41 to press the movable elastic arm 31 so as to make the movable elastic arm 31 deviate from the conductive terminal 2 and open the insertion hole 12.

Furthermore, when the handle 44 of the toggle member 4 is rotated to the locking position, the pusher 42 does not press the movable elastic arm 31 so the movable elastic arm 31 comes in contact with the conductive terminal 2 and the insertion hole 12 is closed.

Also, the toggle member 4 has a link 43. Two ends of a side of the link 43 are separately extended with the handle 44 and the pivot 41. The U-shaped elastic sheet 30 is disposed inside the link 43, the handle 44 and the pivot 41. As a result, when the toggle member 4 is rotated between the locking position and the release position, the link 43, the handle 44 and the pivot 41 will move at a side of the U-shaped elastic sheet 30 without touching the U-shaped elastic sheet 30, and only the pusher 42 will be in contact with the movable elastic arm 31.

Figure 4:
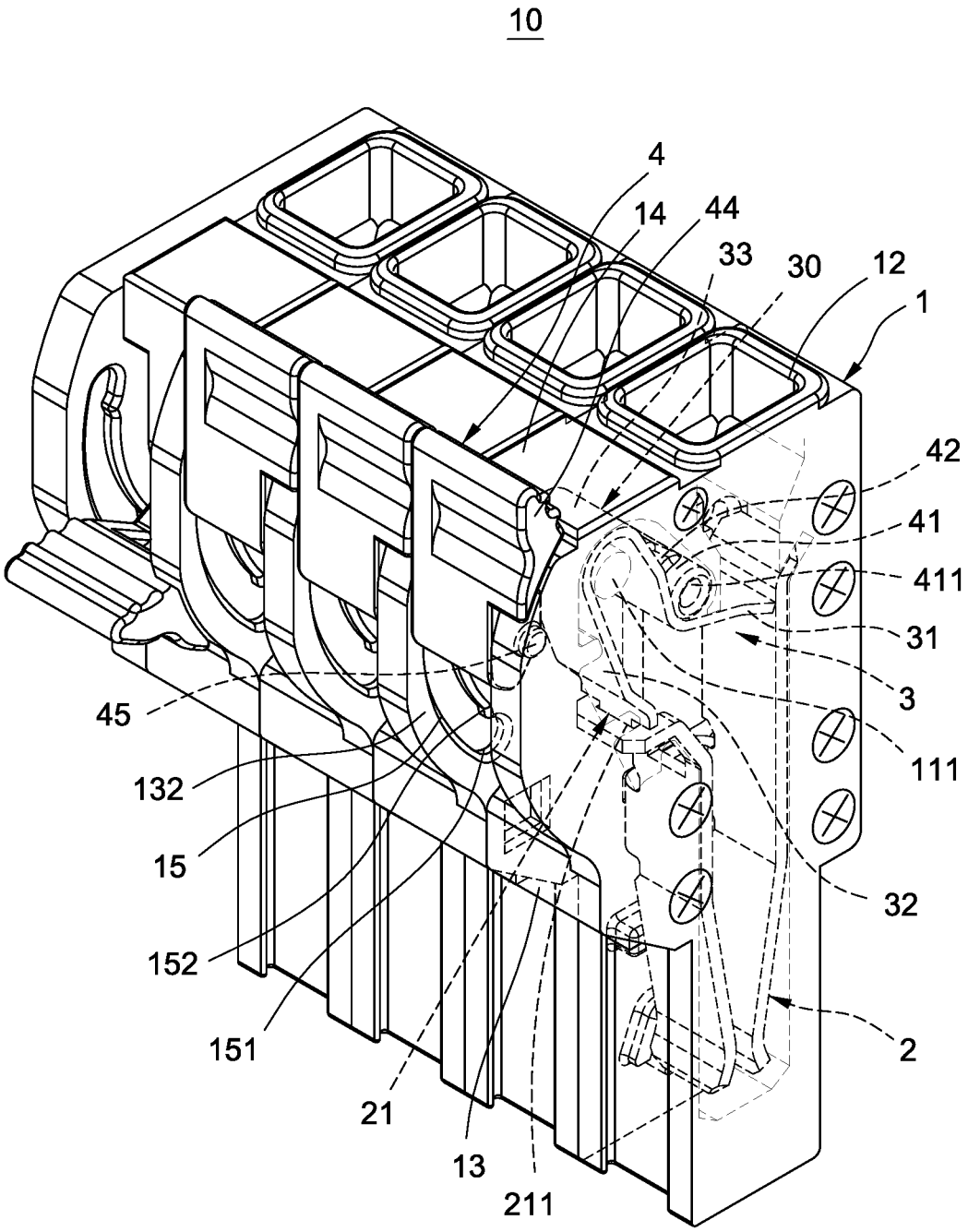
FIG. 4 is an assembled view of the terminal block of the invention.
Figure 5:
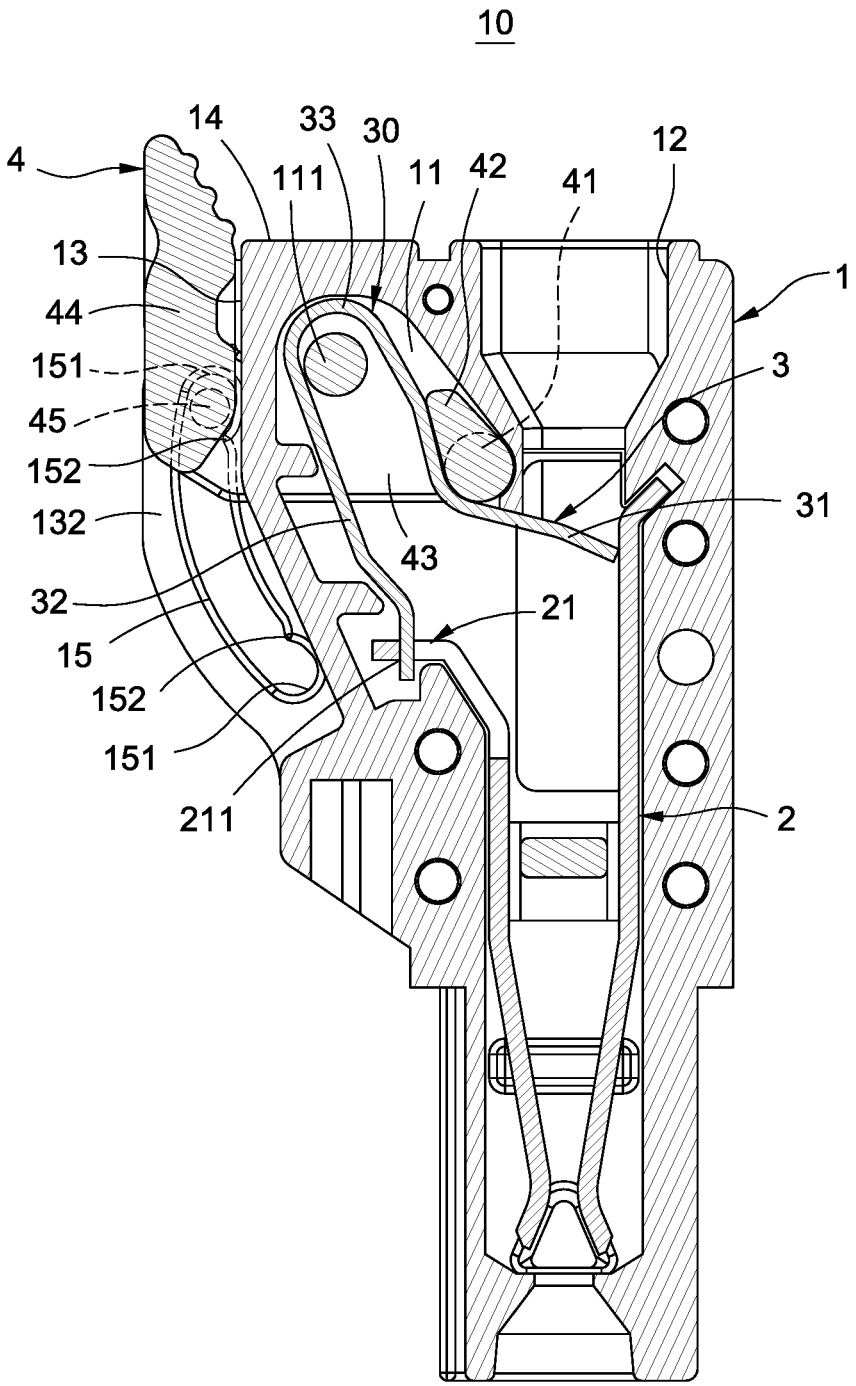
FIG. 5 is a schematic view of the terminal block of the invention in use.
Figure 6:
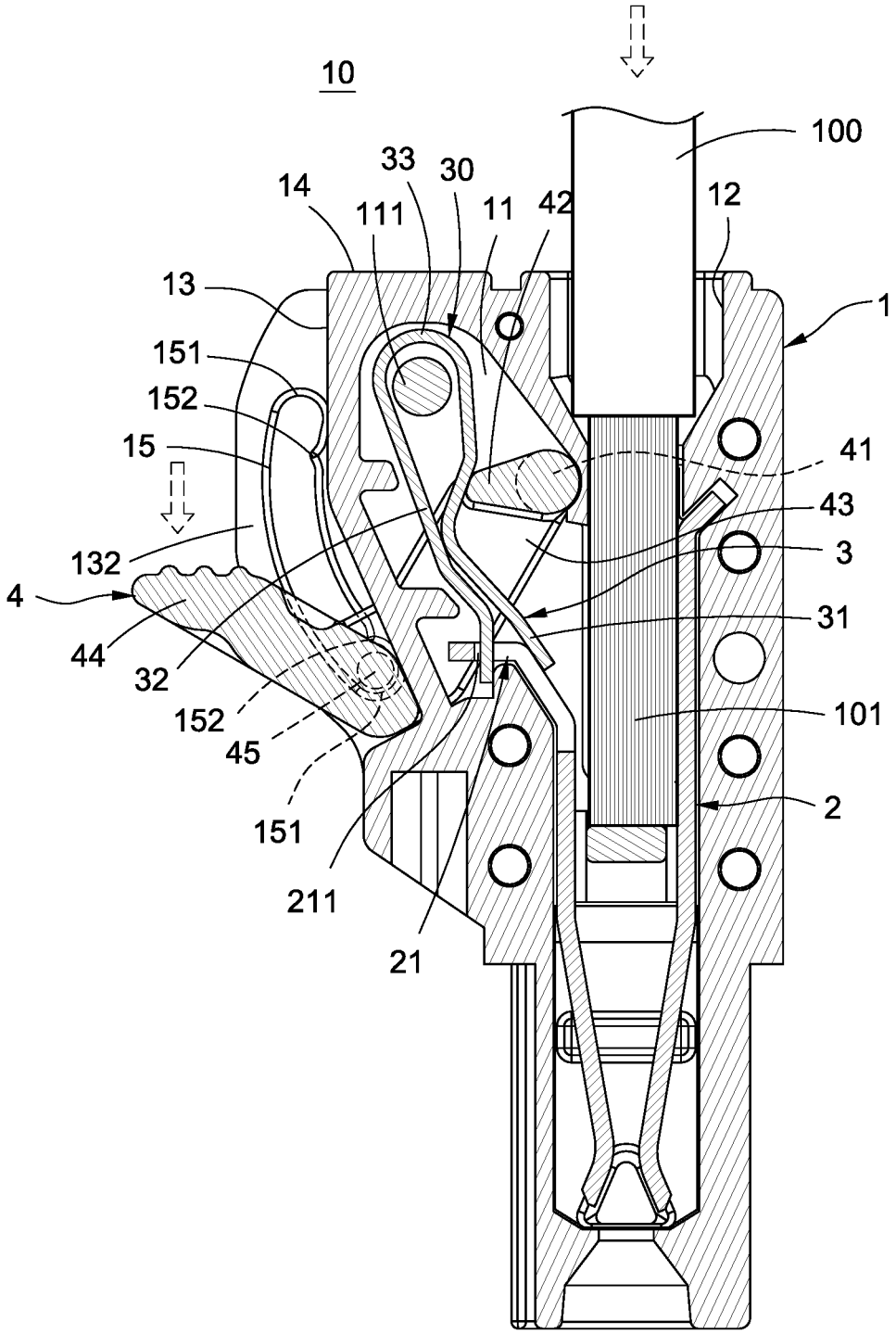
FIG. 6 is another schematic view of the terminal block of the invention in use.

Please refer to FIGS. 4-6, which show the statuses of the terminal block 10 of the invention. First, as shown in FIGS. 4-5, when the handle 44 of the toggle member 4 is rotated to the locking position, the pusher 42 does not press the movable elastic arm 31 so the movable elastic arm 31 comes in contact with the conductive terminal 2 and the insertion hole 12 is closed. At this time, a wire 100 cannot be inserted into the insertion hole 12. After that, as shown in FIG. 6, the handle 44 of the toggle member 4 is rotated to the release position, the pusher 42 is rotated about the pivot 41 to press the movable elastic arm 31 so the movable elastic arm 31 deviates from the conductive terminal 2 and the insertion hole 12 is opened. At this time, the wire 100 can be inserted into the insertion hole 12. Finally, the toggle member 4 is released, the movable elastic arm 31 returns toward the conductive terminal 2 until the movable elastic arm 31 presses a core 101 of the wire 100 to touch the conductive terminal 2. In other words, the movable elastic arm 31 and the conductive terminal 2 jointly clamp the core 101 of the wire 100 to make an electric connection of the wire 100 and the conductive terminal 2.

In comparison with the conventional terminal block which requires a screwdriver or another similar tool, the invention rotates the toggle member 4 to move the movable elastic arm 31 to open or close the insertion hole 12 or to press a core 101 of the wire 100 to create an electric connection with the conductive terminal 2. This avoids requiring a screwdriver or another similar tool to implement a quick connection and release of wires and improves the convenience of terminal blocks.

As shown in FIG. 6, in this embodiment, the toggle member 4 is rotated to the release position, the pusher 42 is rotated about the pivot 41 to a horizontal state and presses the movable elastic arm 31. At this time, a direction of the force exerted by the pusher 42 onto the movable elastic arm 31 is parallel to and offsets a direction of the elastic restoring force of the movable elastic arm 31, so the pusher 42 will latch with the movable elastic arm 31 to automatically stop moving. As a result, an operation of pressing the handle 44 can be omitted to implement toolless wiring.

Further, the toggle member 4 is extended with the projecting rod 45 passing through and is slidable in the arcuate guiding channel 15. When a user moves the handle 44 to the locking position and the release position, the projecting rod 45 will slide across the protrusions 152 for a latching sensation. Finally, the projecting rod 45 will be stopped by one of the protrusions 152 and is temporarily positioned.

As shown in FIGS. 1 and 4, the terminal block 10 of the invention can be connected with others. Multiple insulative bases 1 are connected by a convexity-concavity structure to implement multiple wires 100 being connected to multiple insertion holes 12 and conductive terminals 2.

Figure 7:
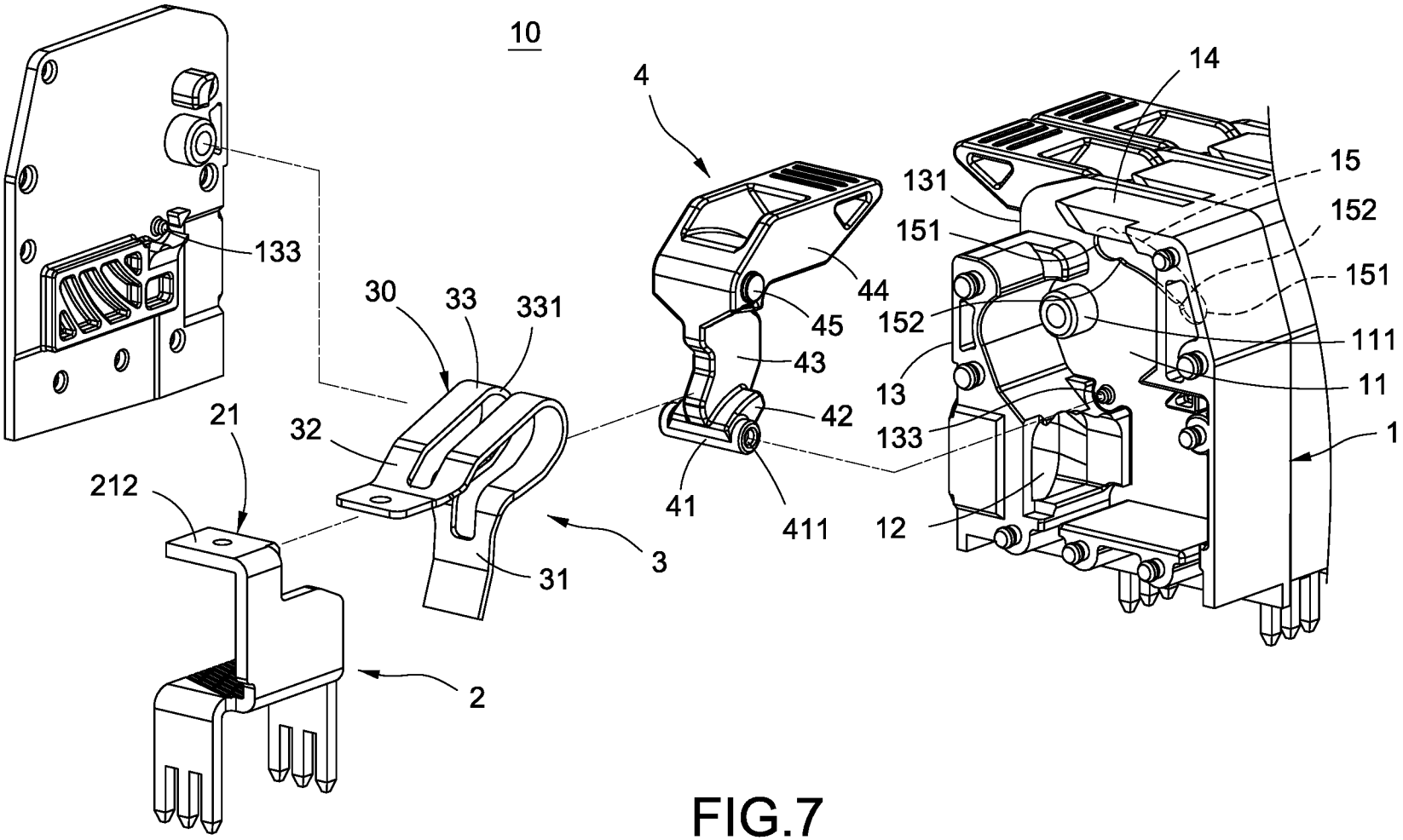
FIG. 7 is an exploded view of another embodiment of the terminal block of the invention.
Figure 8:
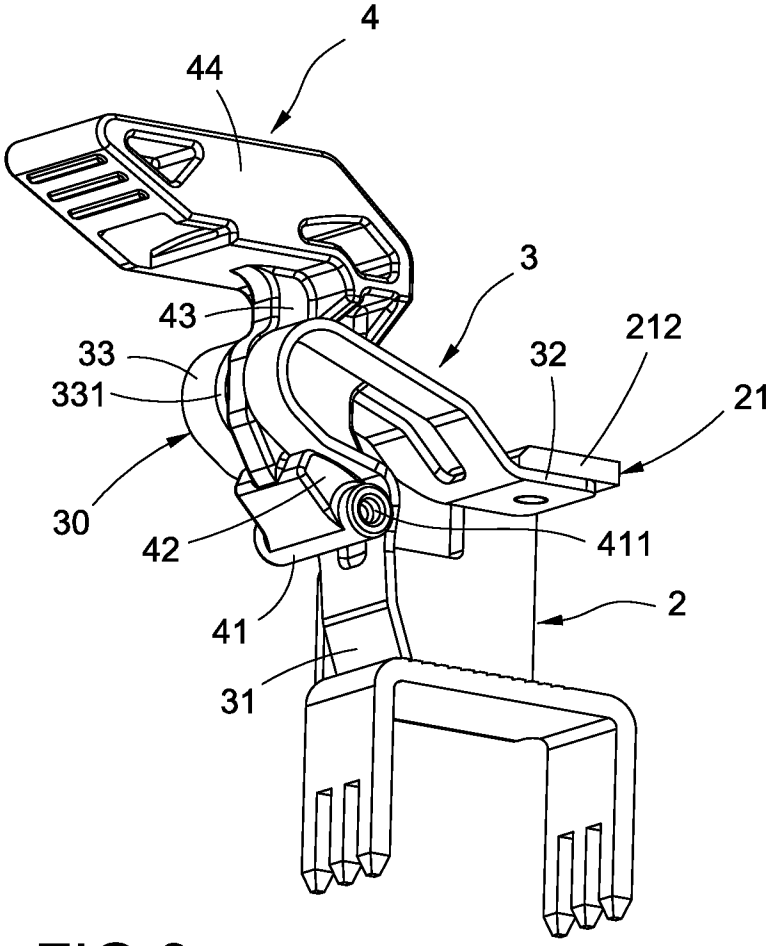
FIG. 8 is an assembled view of another embodiment of the toggle member, the conductive terminal and the flexible clamp of the invention.

As shown in FIGS. 7-8, which show another embodiment of the terminal block 10 of the invention, this embodiment differs from the embodiment shown in FIGS. 1-6 by the insertion hole 12, engaging portion 21, toggle member 4 and bending section 33.

In detail, in this embodiment, the insertion hole 12 is formed in the front wall 13. The engaging portion 21 is a blocking sheet 212, but is not limited to this. A distal end of the positioning elastic arm 32 is stopped and limited by the blocking sheet 212 to engage the distal end of the positioning elastic arm 32 with the engaging portion 21.

Also, in this embodiment, two ends of the link 43 are separately extended with a handle 44 and a pivot 41. The bending section 33 is provided with a U-shaped slot 331 for allowing the link 43 to pass. Thus, when the toggle member 4 is swayed between the locking position and the release position, the link 43 will move in the U-shaped slot 331 without touching the U-shaped elastic sheet 30. The handle 44 and the pivot 41 will move outside the U-shaped elastic sheet 30 without touching the U-shaped elastic sheet 30, and only the pusher 42 will be in contact with the movable elastic arm 31. Thereby, the same functions as the embodiment shown in FIGS. 1-6 can be accomplished.

What is claimed is:

1. A terminal block comprising:

an insulative base, having a chamber therein and an insertion hole thereon, and the insertion hole communicating with the chamber;

a conductive terminal, fixed at a bottom of the insertion hole;

a flexible clamp, received in the chamber, disposed atop the conductive terminal, extended with a movable elastic arm abutting against the conductive terminal and closing the inserting hole; and a toggle member, installed on the insulative base, having a pivot rotatably connected in the chamber, the pivot being extended with a pusher abutting against the movable elastic arm;

wherein when the toggle member is rotated to a release position, the pusher is rotated about the pivot to press the movable elastic arm so as to make the movable elastic arm deviate from the conductive terminal and open the insertion hole;

wherein the insulative base has a front wall and a top wall, the front wall is formed with a through trough communicating with the chamber, and the insertion hole is formed in the front wall or the top wall; and wherein an inner wall of the through trough is extended with two shafts, and the pivot is provided with two pivoting holes which is rotatably inserted by the two shafts.

2. The terminal block of claim 1, wherein the toggle member is swayed between the release position and a locking position, when the toggle member is rotated to the locking position, the pusher does not press the movable elastic arm so as to make the movable elastic arm be in contact with the conductive terminal and close the insertion hole.

3. The terminal block of claim 2, wherein the pusher is disposed above the movable elastic arm, and the toggle member is extended with a handle exposed from the front wall.

4. The terminal block of claim 1, wherein the flexible clamp is a U-shaped elastic sheet, two ends of the U-shaped elastic sheet are separately formed with the movable elastic arm and a positioning elastic arm, and a bending section is formed between the two elastic arms.

5. The terminal block of claim 4, wherein an inner wall of the chamber is extended with a limiting rod, the conductive terminal has an engaging portion, the bending section is put around the limiting rod, a distal end of the positioning elastic arm engages with the engaging portion, and the engaging portion is an engaging groove or a blocking sheet.

6. The terminal block of claim 4, wherein the toggle member has a link, two ends of a side of the link are separately extended with a handle and the pivot, the U-shaped elastic sheet is disposed inside the link, the handle, and the pivot.

7. The terminal block of claim 4, wherein the toggle member has a link, two ends of the link are separately extended with a handle and the pivot, and the bending section is provided with a U-shaped slot for allowing the link to pass.

* * * * *